US006689977B2

(12) United States Patent
Ito et al.

(10) Patent No.: US 6,689,977 B2
(45) **Date of Patent: *Feb. 10, 2004**

(54) KEYSWITCH HAVING A KEYTOP THAT IS UPWARDLY AND DOWNWARDLY MOVABLE AND METHOD OF ASSEMBLING THE SAME

(75) Inventors: Takayuki Ito, Fukushima-ken (JP); Tsuyoshi Narusawa, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/918,926

(22) Filed: Jul. 31, 2001

(65) Prior Publication Data

US 2002/0175063 A1 Nov. 28, 2002

(30) Foreign Application Priority Data

Aug. 7, 2000 (JP) ..... 2000-244045
Aug. 7, 2000 (JP) ..... 2000-244047

(51) Int. Cl.[7] ..... H01H 3/12
(52) U.S. Cl. ..... 200/344
(58) Field of Search ..... 200/344

(56) References Cited

U.S. PATENT DOCUMENTS 5,399,822 A 3/1995 Sato et al. ..... 200/344
5,967,298 A 10/1999 Watanabe et al. ..... 200/344

FOREIGN PATENT DOCUMENTS

EP 0 619 588 A1 10/1994

*Primary Examiner*—Renee Luebke
(74) *Attorney, Agent, or Firm*—Brinks Hofer Gilson & Lione

(57) ABSTRACT

A keyswitch including a lever mounting plate with which the bottom ends of a pair of levers can engage, and an actuator with which the top ends of the pair of levers can engage. The lever mounting plate is mounted to a holding plate, and is placed on a membrane switch. The actuator is mounted to the keytop. The lever mounting plate and the actuator each include a rotation engaging section and a slide engaging section. The rotation engaging section has an open portion and allows a rotating pin of one of lever members to rotatably engage therewith. The slide engaging section has an open portion, and allows a slide pin of the other lever member to engage therewith. The open portion of the rotation engaging section and that of the slide engaging section open in the same direction so that the pair of lever members can be mounted to the lever mounting plate and to the actuator by only moving the pair of lever members from one side to the other.

9 Claims, 13 Drawing Sheets

KEYSWITCH HAVING A KEYTOP THAT IS UPWARDLY AND DOWNWARDLY MOVABLE AND METHOD OF ASSEMBLING THE SAME

BACKGROUND OF THE INVENTION

1. Field of the Invention

The present invention relates to a keyswitch for use in a keyboard device, and more particularly, to a keyswitch having a keytop that is upwardly and downwardly movable. In addition, the present invention relates to a method of assembling the keyswitch.

2. Description of the Related Art

In recent years, keyswitches suitable for use in keyboard input devices have been proposed in which the top ends of a pair of lever members linked so as to cross each other are supported at a keytop, and, with the upward and downward movement of the keytop, the angle at which the pair of lever members cross each other is changed.

For example, there has been disclosed a keyswitch having a structure in which one of the lever members (the lever member whose top end rotatably engages the back surface of a keytop) and the other lever member (the lever member whose top end slidably engages the back surface of the key top) are linked at a portion where they cross each other so as to be formed into an integral structure, and the integrally formed pair of lever members guide the upward and downward movement of the keytop.

This type of keyswitch is turned on in the following manner. When an operator pushes the keytop, the pair of lever members are tilted and pushed downward. When the keytop has moved downward by a predetermined amount, an elastic member, such as a click rubber, is pushed by the keytop and deformed, after which a switch element of, for example, a membrane switch, is pushed by the elastic member to thereby turn on the keyswitch.

When the pushing operational force on the keytop is removed, the deformed elastic member is restored to its original shape due to its own resilient force, thereby bringing the membrane switch into an OFF state, and simultaneously pushing the keytop up to its initial height while causing the tilted pair of lever members to stand upright.

Accordingly, as compared to a conventional keyswitch whose key stem is slid along a guide wall, the structure in which a keytop is supported by a pair of lever members so as to be movable up and down achieves an ease of operation and a reduction in the height of the keyswitch.

In such a keyswitch, the membrane switch is placed on a metal plate, and portions of the metal plate are cut upward to form engaging portions. Bottom ends of the pair of combined lever members engage their corresponding engaging portions for assembly, whereby the top ends of the pair of combined lever members are movable upward and downward.

However, the keytop used in this type of conventional keyswitch is formed thin in order to make the keyswitch thin. In addition, a rotation engaging section and a slide engaging section are integrally formed at the back surface of the thin keytop in order to rotatably and slidably engage the top ends of the pair of lever members.

The shapes of the rotation engaging section and the slide engaging section are complicated. Thus, the shape of the keytop is likewise complicated. Therefore, the structure of a molding die used to form the keytop (by molding) becomes complicated, thereby resulting in an increase in the cost of the keytop.

In addition, since the rotation engaging section and the slide engaging section of the keytop are formed at the back surface of the keytop by molding, the assembly operation of engaging the top ends of the pair of lever members with the rotation engaging section and the slide engaging section of the keytop, respectively, becomes complicated, thereby making it difficult to automate the assembly operation.

This type of conventional keyswitch is assembled by engaging the bottom ends of the pair of combined lever members with the corresponding engaging portions formed by cutting up portions of the metal plate. However, since the bottom ends of the pair of lever members are mounted to the engaging portions after the membrane switch is placed on the metal plate, the sheet-shaped membrane switch becomes wavy or the like, thereby making it difficult to perform the assembly operation of engaging the pair of lever members with the engaging portions of the metal plate.

SUMMARY OF THE INVENTION

Accordingly, in view of the first two problems, it is an object of the present invention to provide a keyswitch that can be reduced in cost by forming a plate-shaped actuator having a rotation connecting section and a slide connecting section with which top ends of a pair of lever members engage. The actuator is formed separately from the keytop, and is mounted by press-fitting it to the keytop.

In view of the third problem, it is an object of the present invention to provide a keyswitch which can be easily assembled, and whose assembly operation is easily automated by placing a lever mounting plate on the membrane switch, which is provided separately from the metal plate, and with which bottom ends of a pair of lever members engage. In addition, it is an object of the present invention to provide a method of assembling the keyswitch.

To these ends, according to a first aspect of the present invention, there is provided a keyswitch comprising a pair of lever members which are rotatably linked at a portion where the lever members cross each other, a keytop supported by the pair of lever members so as to be upwardly and downwardly movable, an elastic member for elastically biasing the keytop upwardly, and a switch element which is subject to a switching operation with the upward and downward movement of the keytop. An actuator, with which the top ends of the pair of lever members are engageable, is disposed in the keytop. In addition, the keytop is held by the actuator. Further, the elastic member directly elastically biases the keytop. Still further, with the upward and downward movement of the keytop, the pair of lever members are upwardly and downwardly movable through the actuator.

In a first form of the first aspect, a prismatic protrusion is formed at a portion of the keytop that is stopped by the actuator, and side surfaces formed at a periphery of the prismatic protrusion are formed flat. In addition, the actuator has a dislodging preventing stopper portion capable of preventing the actuator from becoming dislodged by being press-contacted to the side surfaces at the periphery of the protrusion, a plurality of press-contact portions supported in a cantilever manner being provided at the dislodging-preventing stopper portion, and the press-contact portions being press-contacted to the corresponding side surfaces at the protrusion so that the keytop will be held by the actuator.

In a second form based upon the first form, the press-contact portions are formed so as to be supported in the cantilever manner by causing the press-contact portions to protrude inwardly from an inner peripheral wall defining a hole which passes through the actuator, and ends of the press-contact portions are such as to press-contact the corresponding side surfaces at the protrusion.

In a third form based upon the second form, the actuator is formed of a metallic plate, and the press-contact portions are formed so as to protrude inwardly from four directions of the inner peripheral wall defining the hole. In addition, the keytop is formed of a resin material, and the prismatic protrusion has the shape of a square pole. Further, the press-contact portions are press-fitted to the corresponding four side surfaces at the periphery of the square-pole-shaped protrusion.

In a fourth form based upon the third form, the square-pole-shaped protrusion has a cross-shaped presser portion formed so as to protrude in a diagonal direction from a corner where the side surfaces intersect each other, the length of the presser portion in the diagonal direction being greater than the size of a top portion of the elastic member, and the presser portion being brought into contact with the top portion of the elastic member in order for the elastic member to elastically bias the keytop.

According to a second aspect of the present invention, there is provided a keyswitch comprising a pair of lever members which are rotatably linked at a portion where the lever members cross each other, a keytop supported by the pair of lever members so as to be upwardly and downwardly movable, an elastic member for elastically biasing the keytop upwardly, and a switch element which is subject to a switching operation with the upward and downward movement of the keytop. A lever mounting plate, with which bottom ends of the pair of lever members are engageable, is mounted to a holding plate and is placed on the switch element. In addition, the lever mounting plate includes a rotation engaging section and a slide engaging section. The rotation engaging section has an open portion and allows the bottom end of one of the lever members to rotatably engage therewith. The slide engaging section has an open portion and allows the bottom end of the other lever member to slidably engage therewith. The open portion of the rotation engaging section and the open portion of the slide engaging section open in the same direction.

In one form of the second aspect of the present invention, the lever mounting plate is a metallic plate. The lever mounting plate has a pair of first cut-up portions at one side thereof. In addition, the slide engaging section which has the open portion is formed into a U shape at the first cut-up portions, and two opposing sides of the U-shaped slide engaging section are formed parallel to each other.

In another form of the second aspect of the present invention, a pair of second cut-up portions are formed at the other side of the lever mounting plate so as to be separated from the first cut-up portions, the rotation engaging section being formed into a U shape at the second cut-up portions, and a protrusion being formed near the open portion at either one of or both opposing sides of the rotation engaging section, the protrusion being provided to reduce the width of the open portion.

According to a third aspect of the present invention, there is provided a method of assembling a keyswitch, wherein a pair of lever members which are rotatably linked at a portion where the lever members cross each other are provided; wherein top ends of the pair of lever members are made upwardly and downwardly movable through an actuator with the upward and downward movement of a keytop, which is elastically biased by an elastic member; wherein bottom ends of the pair of lever members are made engageable with a lever mounting plate; wherein the bottom ends of the pair of lever members are positioned on the lever mounting member, the pair of lever members are moved from one side to the other, and the bottom ends of the pair of lever members are made to engage the lever mounting plate in order to assemble the keyswitch.

In a form of the third aspect of the present invention, by moving the pair of lever members from one side to the other, the bottom end of one of the lever members engages a rotation engaging section of the lever mounting plate by a snap-in operation so that the one of the lever members is rotatable thereat, and the bottom end of the other lever member is slid to engage a slide engaging section of the lever mounting plate so that the other lever member is slidable thereat.

DESCRIPTION OF THE PREFERRED EMBODIMENT

Figure 1:
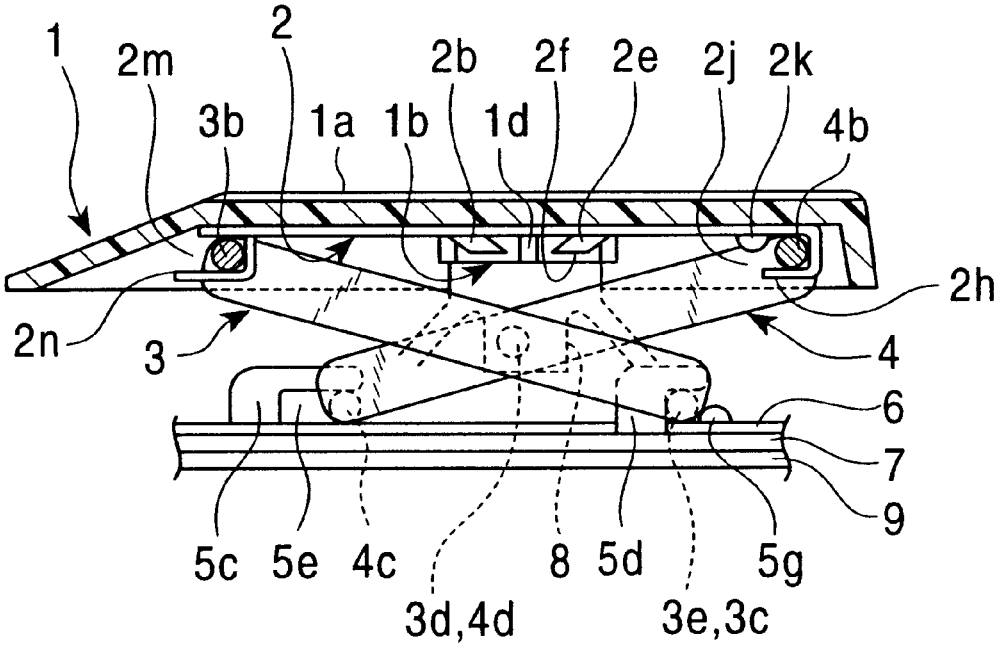
FIG. 1 is a sectional view of the main portion of a keyswitch in accordance with the present invention.
Figure 3:
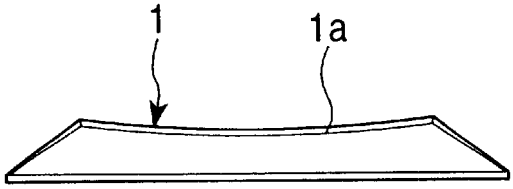
FIG. 3 is a front view of a keytop used in the present invention.

As shown in FIG. 1, a keyswitch of the present invention has a keytop 1 at the topmost portion thereof. The keytop 1 is described with reference to FIGS. 3 to 5.

The keytop 1 is, for example, molded out of a resin material so as to have a substantially rectangular external shape. The top surface of the keytop 1 is formed as an operating surface 1*a* having a circular arc shape. A square-pole-shaped protrusion 1*b* protrudes from substantially the center portion of the back surface of the keytop 1. The keytop 1 has four side surfaces 1*c* that surround the square-pole-shaped protrusion 1*b*. The side surfaces 1*c* are formed flat.

A cross-shaped presser portion 1*d* is formed so as to protrude outward in a diagonal direction from a corner of the protrusion 1*b* where the side surfaces 1*c* intersect. A size A of the presser portion 1*d* in the diagonal direction is longer than diameters C of top portions 8*c* of elastic members 8 (described later). The elastic members 8 directly elastically bias the presser portion 1*d* in order to allow the keytop 1 to move up and down.

Figure 4:
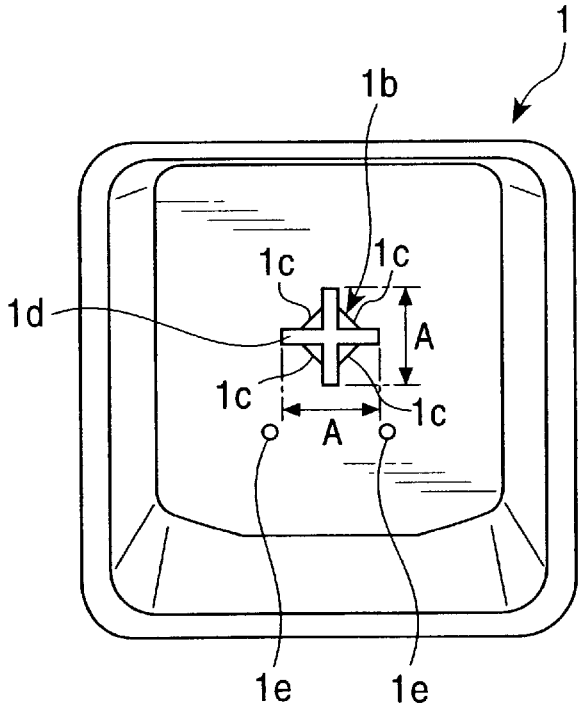
FIG. 4 is a bottom view of FIG. 3.
Figure 5:
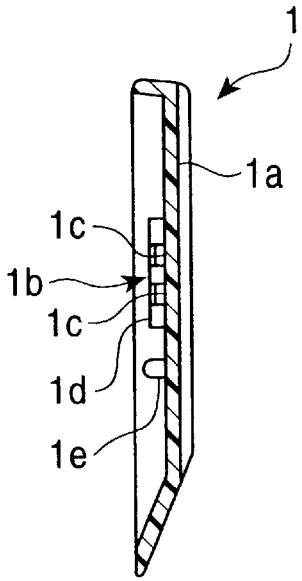
FIG. 5 is a sectional view of the main portion of FIG. 4.

A pair of positioning protrusions 1*e* are formed near the bottom portion of the protrusion 1*b* shown in FIG. 4.

An actuator 2, which stops the protrusion 1*b* of the keytop 1, is formed of a metallic plate, such as a stainless steel plate. When the keytop 1 is stopped by the actuator 2, a flat mounting surface 2*a* is such as to be mounted in close contact with the bottom surface of the keytop 1.

A dislodging-preventing stopper portion 2*b*, to which the protrusion 1*b* of the keytop 1 can be press-fitted, is formed at substantially the center portion of the mounting surface 2*a*. At the dislodging-preventing stopper portion 2*b*, four press-contact portions 2*e* supported in a cantilever manner are disposed so as to protrude inwardly from the four directions of an inner peripheral wall 2*d* defining a through hole 2*c*.

Figure 8:
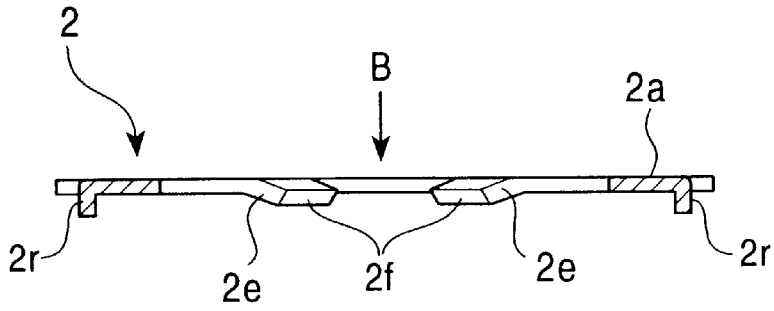
FIG. 8 is an enlarged sectional view of the main portion of FIG. 6.

As shown in the enlarged view of FIG. 8, the press-contact portions 2*e*, supported in a cantilever manner, are bent slightly downwards at end portions 2*f*. When the protrusion 1*b* of the keytop 1 is press-fitted to the dislodging-preventing stopper portion 2*b* from the direction of arrow B, the end portions 2*f* of the press-contact portions 2*e* are press-contacted to the four corresponding side surfaces 1*c* surrounding the protrusion 1*b* in order to stop the keytop 1 so that it does not get dislodged from the actuator 2.

Since the actuator 2 is formed of a metallic plate and the keytop 1 is formed of a resin material, the end portions 2*f* of the press-contact portions 2*e* are such as to be driven into the side surfaces 1*c*, so that the force required to pull the keytop 1 out of the actuator 2 can be made large, thereby making it possible to firmly stop dislodgement of the keytop 1 from the actuator 2.

Figure 6:
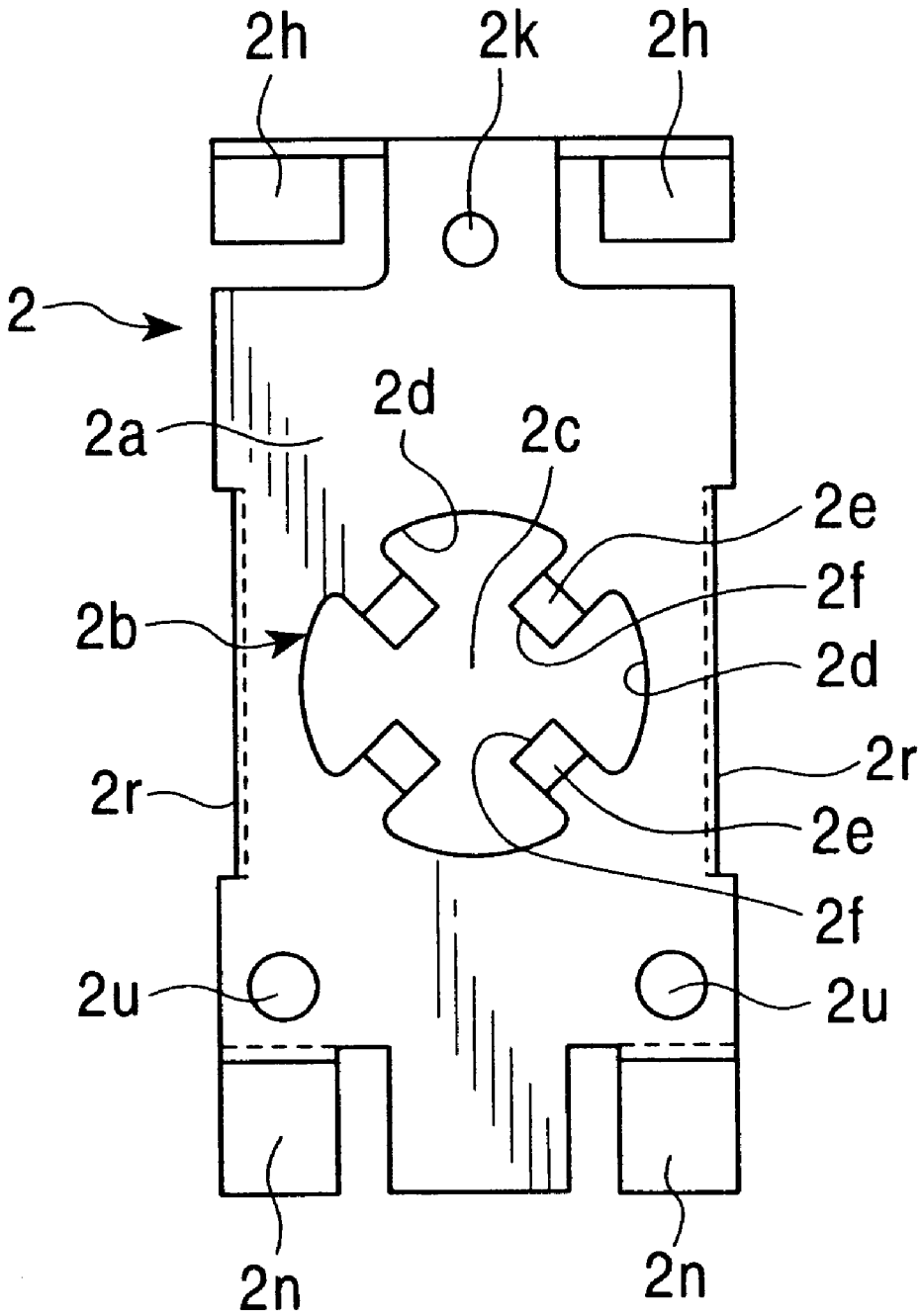
FIG. 6 is a plan view of an actuator used in the present invention.
Figure 7:
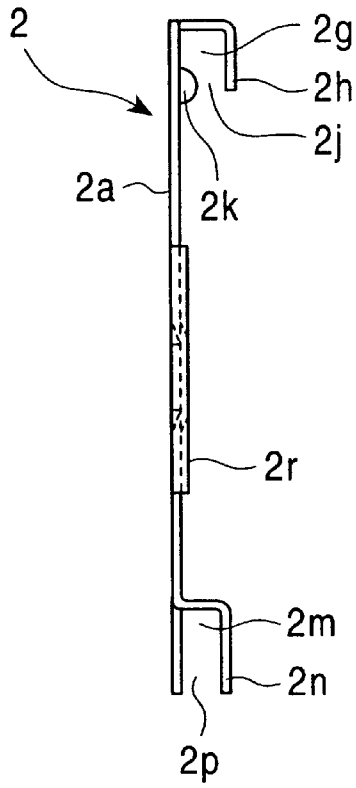
FIG. 7 is a side view of FIG. 6.

A rotation engaging section 2*g*, whose side is bent into a substantially U shape, is formed at one end portion (that is, the top end portion side) of the mounting surface 2*a* (shown in FIG. 7) in the longitudinal direction thereof. As shown in FIG. 6, engaging portions 2*h* and 2*h* are formed at the rotation engaging section 2*g*. The engaging portions 2*h* and 2*h* are spaced away portions parallel to the mounting surface 2*a* that extend from the upwardly extending portion of the mounting surface 2*a* (as shown in FIG. 6) towards the central portion thereof. As shown in FIG. 7, the engaging portions 2*h* and 2*h* are formed by a cutting and bending operation in order to form the rotation engaging section 2*g*.

As shown in FIG. 7, the side surface of the rotation engaging section 2*g* is formed into a U shape by opposing a side of the mounting surface 2*a* with sides of the engaging portions 2*h*. The rotation engaging section 2*g* has open portions 2*j* which face downward in FIG. 7. A protrusion 2*k*, which decreases the widths of the open portions 2*j*, is formed on the mounting surface 2*a* near the open portions 2*j*.

By a snap-in operation of a top end rotating shaft 4*b*, or the top end of an outer lever 4 (described later), with respect to the rotation engaging section 2*g* inward from the open portions 2*j* (whose widths are made smaller), the top end rotating shaft 4*b* is such as to be rotatable inside the rotation engaging section 2*g*.

The protrusion 2*k*, which decreases the widths of the open portions 2*j*, may be formed at the engaging portions 2*h* and 2*h* or at the mounting surface 2*a* and the engaging portions 2*h*. These protrusions are not shown.

In other words, the protrusion 2*k* may be formed at the mounting surface 2*a* or the engaging portions 2*h* (which are opposing sides defining the open portions 2*j*), or both, near the open portions 2*j*.

A slide engaging section 2*m* having an open portion 2*p* whose side has a substantially U shape is formed at the other end portion (that is, the bottom end portion side shown in FIG. 7) of the mounting surface 2*a* in the longitudinal direction thereof.

As shown in FIG. 6, tongue-shaped engaging portions 2*n* and 2*n* are formed at the slide engaging section 2*m*. These engaging portions 2*n* and 2*n* are formed at the left and right sides (in FIG. 6) of an illustrated downwardly extending portion of the mounting surface 2*a* near the central portion thereof. The engaging portions 2*n* and 2*n* have their side surfaces bent into U-shapes.

The slide engaging section 2*m* is formed by positioning the mounting surface 2*a* and the engaging portions 2*n* (which are opposing sides defining open portions 2*p*) parallel to each other. A top end slide shaft 3*b*, or the top end of an inner lever member 3, engages the slide engaging section 2*m* so as to be slidable thereat.

As shown in FIG. 7, the open portions 2*j* of the rotation engaging section 2*g* and the open portions 2*p* of the slide engaging section 2*m* open downward in the same direction.

As shown in FIG. 6, positioning holes 2*u* and 2*u* are formed as through holes in portions of the mounting surface 2*a* near the top portions of the engaging portions 2*n* and 2*n* that form the slide engaging section 2*m*. The positioning protrusions 1*e* of the keytop 1 can be fitted to the corresponding positioning holes 2*u* and 2*u*.

As shown in FIG. 6, a pair of reinforcing portions 2*r* are formed on the left and right sides of the portion of the mounting surface 2*a* where the dislodging-preventing stopper portion 2*b* is formed.

When the lever member 3 and the lever member 4 (described later) are made to engage the slide engaging section 2*m* and the rotation engaging section 2*g*, respectively, the reinforcing portions 2*r* prevent the flat mounting surface 2*a* from warping even when the actuator 2 moves up and down.

Figure 13:
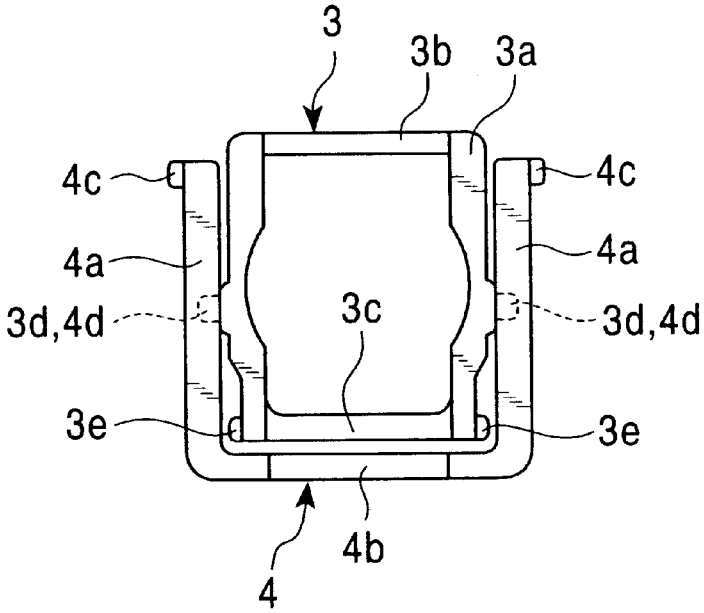
FIG. 13 is a plan view of an integrally formed pair of lever members used in the present invention.

The pair of lever members, one of which engages the rotation engaging section 2*g* and the other of which engages the slide engaging section 2*m*, comprises the inner lever member 3 and the outer lever member 4. The inner lever member 3 and the outer lever member 4 are molded out of resin materials having different contraction rates, and are formed into an integral structure as shown in FIG. 13.

In other words, the inner lever member 3 and the outer lever member 4 are formed into an integral structure by assembling them using a mold and using different materials.

Figure 9:
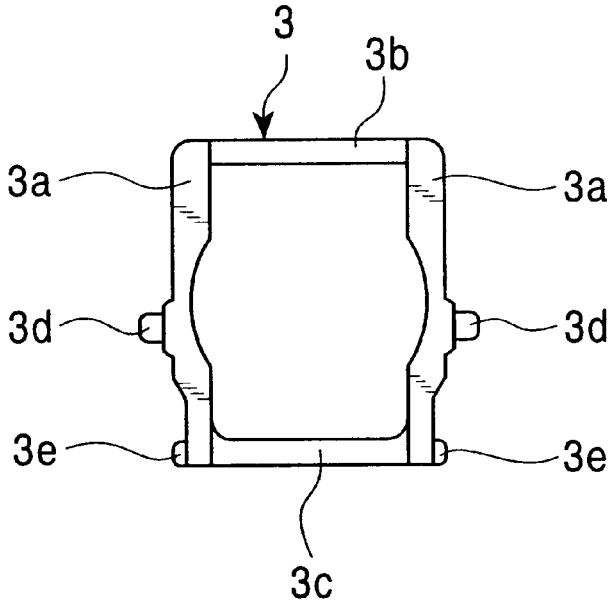
FIG. 9 is a plan view of an inner lever member used in the present invention.
Figure 10:
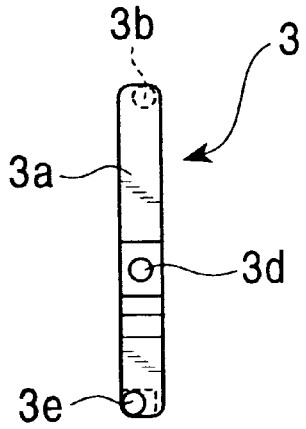
FIG. 10 is a side view of FIG. 9.

As shown in FIGS. 9 and 10, the inner lever member 3 has a pair of tilting legs 3*a* that extend vertically upward and downward. The tilting legs 3*a* and 3*a* are connected to the top end slide shaft 3*b*, formed at the upper part in FIGS. 9 and 10, and a bottom end rotation shaft 3*c*, formed at the lower part in these figures, so that the inner lever member 3 has a substantially rectangular external shape.

Outwardly protruding connecting pins 3*d* are formed at the middle of the corresponding tilting legs 3*a* (as viewed in the vertical direction in FIGS. 9 and 10), at the sides of the inner lever member 3. Protruding bottom end rotating pins 3*e* are formed outwardly from the corresponding tilting legs 3*a* on a line coincident with the rotating pin 3*c*.

As shown in FIG. 1, the top end slide shaft 3*b* (or the top end) of the inner lever member 3 slidably engages the slide engaging section 2*m* of the actuator 2, and the bottom end rotating shaft 3*c* (that is, the bottom end) of the inner lever member 3 and the bottom end rotating pins 3*e* rotatably engage and are mounted to a lever mounting plate 5 (described later).

Figure 11:
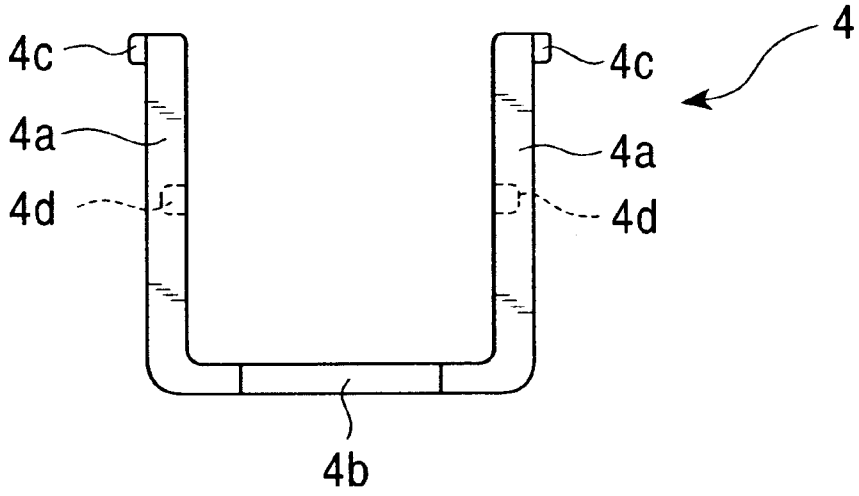
FIG. 11 is a plan view of an outer lever member used in the present invention.
Figure 12:
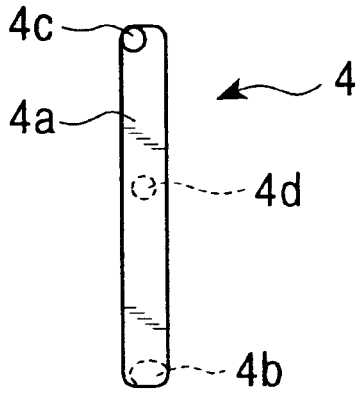
FIG. 12 is a side view of FIG. 11.

As shown in FIGS. 11 and 12, the outer lever member 4 has a pair of tilting legs 4*a* that extend vertically upward and downward. The tilting legs 4*a* and 4*a* are connected to the top end rotating shaft 4*b* (formed at the lower part in FIGS. 11 and 12), so that the outer lever member 4 has a U-shaped external form.

Protruding bottom end slide pins 4*c* and 4*c* are formed at the outer top portions of the sides of the corresponding tilting legs 4*a* shown in FIG. 11. Pin insertion holes 4*d* are formed with predetermined depths at the middle portions of the corresponding tilting legs 4*a* (as viewed in the vertical direction in FIGS. 11 and 12) so as to extend from the inside to the outside. The connecting pins 3*d* of the inner lever member 3 can be rotatably fitted to the corresponding pin insertion holes 4*d*.

As shown in FIG. 1, the top end rotating shaft 4*b*, or the top end of the outer lever member 4, rotatably engages the rotation engaging section 2*g* of the actuator 2, and bottom end slide pins 4*c*, or the bottom end of the outer lever member 4, slidably engages and is mounted to the lever mounting plate 5 (described later).

Figure 14:
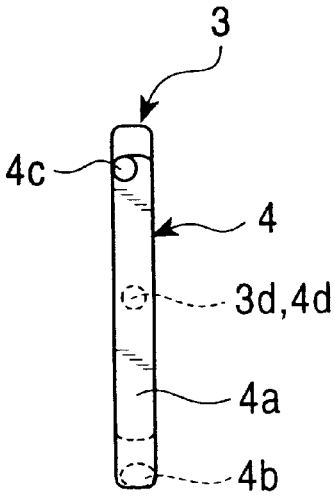
FIG. 14 is a side view of FIG. 13.
Figure 15:
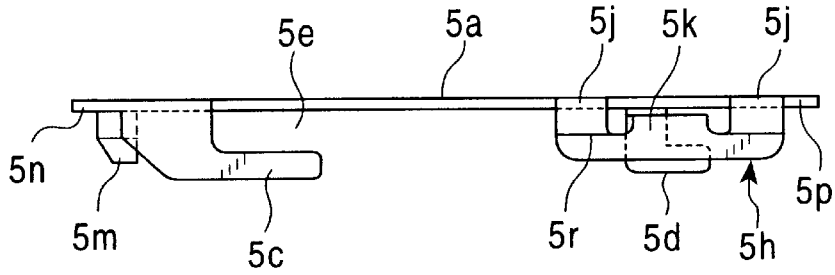
FIG. 15 is a side view of the top portion of a lever mounting plate used in the present invention.

When two-color molding is carried out, as shown in FIGS. 13 and 14, the pair of lever members 3 and 4 are formed into an integral structure by connecting them so that that they can rotate as a result of carrying out a molding operation while the connecting pins 3*d* are fitted to the corresponding pin insertion holes 4*d*, serving as crossing portions.

In accordance with changes in the tilting angles of the tilting legs 3*a* and 4*a*, the top end slide shaft 3*b* of the lever member 3 and the top end rotating shaft 4*b* of the lever member 4 are such that their heights change.

With reference to FIGS. 15 to 18, the lever mounting plate 5 for rotatably engaging the bottom end rotating shaft 3*c* and the bottom end rotating pins 3*e*, or the bottom end of the inner lever member 3, and for slidably engaging the bottom end slide pins 4*c*, or the bottom end of the outer lever member 4, is described.

Figure 17:
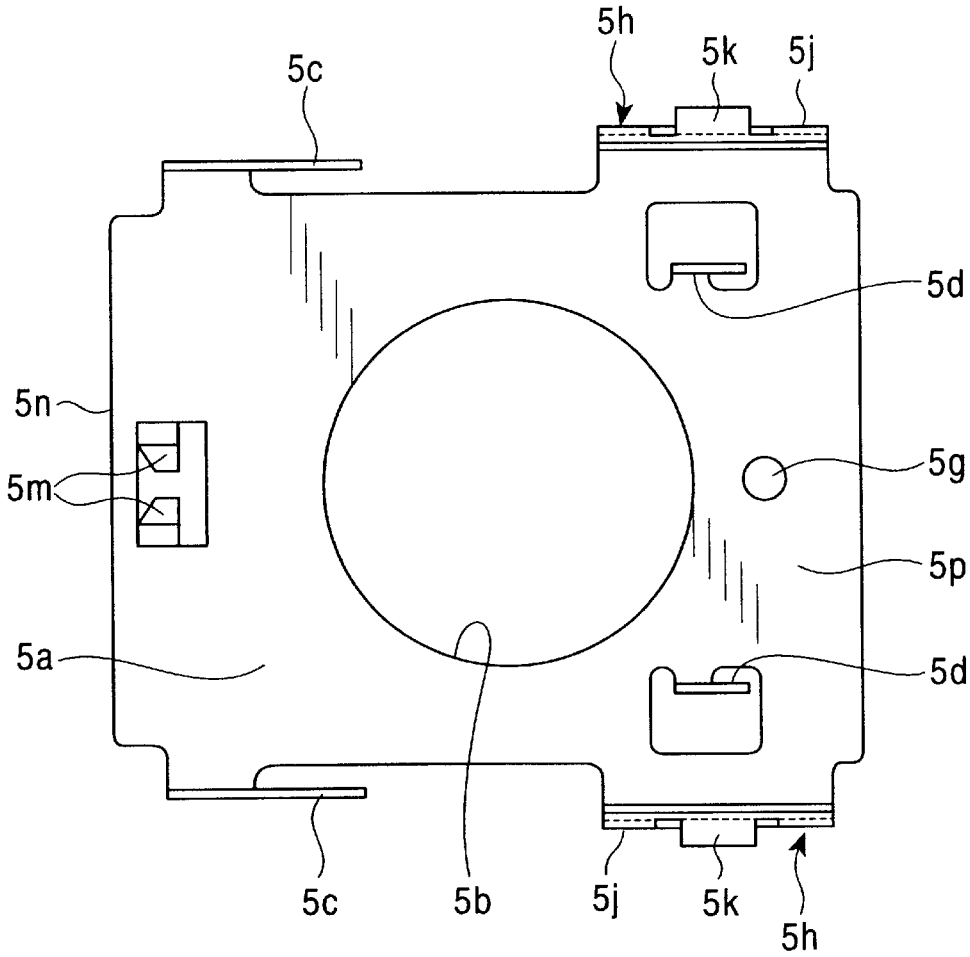
FIG. 17 is a plan view of FIG. 15.

The lever mounting plate 5 is formed of a metallic plate, such as a stainless steel plate, and, as shown in FIG. 17, the lever mounting plate 5 is formed with a substantially rectangular external shape by, for example, a pressing operation. The lever mounting plate 5 has a substantially rectangular base 5*a*, with a circular through hole 5*b* for inserting the elastic members 8 (described later) being formed in substantially the central portion of the base 5*a*.

A pair of first cut-up portions 5*c* are formed at the top and bottom sides of the left end portion of the base 5*a* shown in FIG. 17. A pair of second cut-up portions 5*d* are formed above and below the through hole 5*b*, at the right side portion of the base 5*a*.

Figure 18:
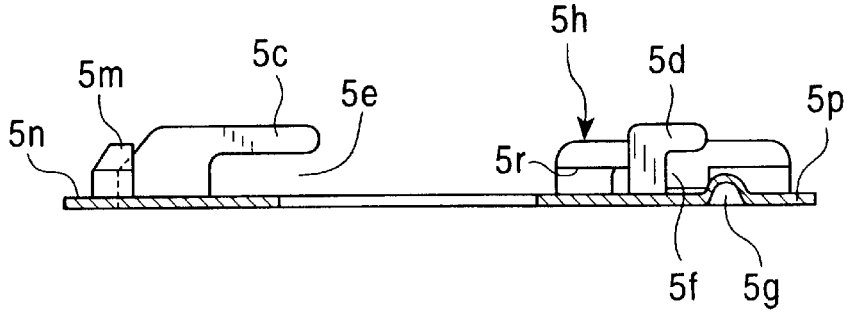
FIG. 18 is a front view of FIG. 17.

As shown in FIG. 18, the first cut-up portions 5*c* and the second cut-up portions 5*d* have substantially L-shaped sides. U-shaped slide engaging sections 5*e* are formed at the first cut-up portions 5*c*, with the bottom end slide pins 4*c*, or the bottom end of the outer lever member 4, being engageable with them.

U-shaped rotation engaging sections 5*f*, that are shallower than the slide engaging sections 5*e*, are formed at the second cut-up portions 5*d*. The bottom end rotating pins 3*e*, or the bottom end of the inner lever member 3, can engage with them.

A protrusion 5*g*, that protrudes upward from the base 5*a*, is formed near the open portions of the rotation engaging sections 5*f* (shown in FIG. 18) at substantially the center portion of the base 5*a* between the pair of second cut-up portions 5*d* and 5*d* (shown in FIG. 17). The protrusion 5*g* narrows the width of the open portions at the sides of the rotation engaging sections 5*f*.

Therefore, when the bottom end rotating pins 3*e*, or the bottom end of the inner lever member 3, are pushed into and engage the rotation engaging sections 5*f*, the bottom end rotating shaft 3*c* is subjected to a snap-in operation by the protrusion 5*g*, so that the bottom end rotating pins 3*e* engage within the rotation engaging sections 5*f* so that they can rotate.

The open portions of the slide engaging sections 5*e* and the rotation engaging sections 5*f* open in the same direction, that is, towards the right in FIG. 18.

Therefore, by inserting the bottom ends of the pair of lever members into the slide engaging sections 5*e* and the rotation engaging sections 5*f* from the same direction, the pair of lever members 3 and 4 can be mounted to the lever mounting plate 5, thereby making it easy to automate the assembly operation.

The protrusion 5*g* is formed at substantially the center portion interposed between the pair of second cut-up portions 5*d* and 5*d* shown in FIG. 17. By the protrusion 5*g*, the entrances of the rotation engaging sections 5*f*, formed at the second cut-up portions 5*d* and 5*d* shown in FIG. 18, are made narrow.

Therefore, when the bottom-end rotating pins 3*e*, or the bottom end of the inner lever member 3, are pushed into the rotation engaging sections 5*f*, the bottom-end rotating shaft 3*c* is subjected to a snap-in operation by the protrusion 5*g*, so that the bottom-end rotating pins 3*e* rotatably engage inside the rotation engaging sections 5*f*.

As shown in FIG. 17, stopper portions 5*h* for temporarily attaching the lever mounting plate 5 to a holding plate 6 (described later) are formed by cutting upwards both top and bottom side portions where the corresponding second cut-up portions 5*d* are formed.

Figure 16:
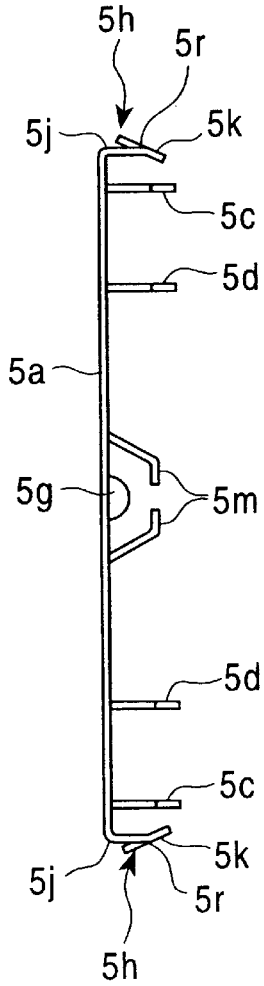
FIG. 16 is a left side view of FIG. 15.

As shown in FIG. 16, side walls 5*j* are formed at their corresponding stopper portions 5*h* by cutting up at right angles both top and bottom side portions of the base 5*a*.

Hooks 5*k* are formed by cutting off left and right portions near the central portions of their corresponding side walls 5*j* (shown in FIG. 15) from the base 5*a*. The hooks 5*k* and the corresponding side walls 5*j* are formed so that upper right sides (shown in FIG. 16) thereof are bent inwardly at predetermined angles from corresponding bending lines 5*r*.

Third cut-up portions 5*m* are formed at the left end center portion of the base 5*a* (shown in FIG. 17). A left end 5*n* is formed by the extension of a portion of the base 5*a* towards the left (in FIG. 17) of the third cut-up portions 5*m*.

A right end portion 5*p* is formed by the extension of a portion of the base 5*a* disposed between the upper and lower stopper portions 5*h* towards the right.

Figure 19:
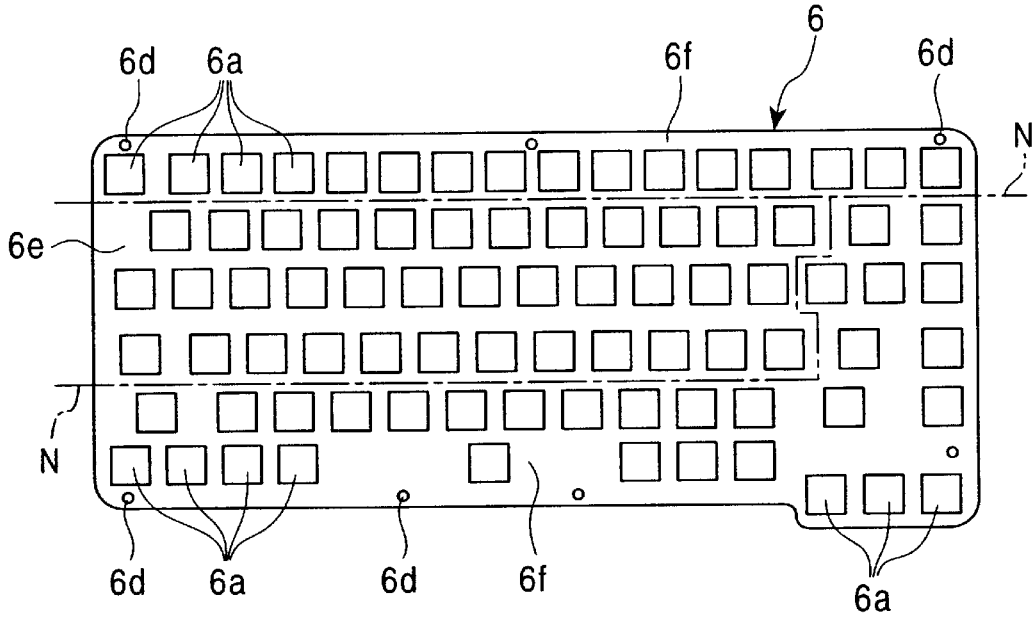
FIG. 19 is a plan view of a holding plate used in the present invention.

The holding plate 6, for snapping in the stopper portions 5*h* of the lever mounting plate 5, is a plate, such as a metallic plate formed of, for example, stainless steel, for arranging keys thereon. As shown in FIG. 19, in accordance with the arrangement of a plurality of keys of a keyboard, a plurality of mounting holes 6*a* are punched out by, for example, a pressing operation.

Figure 20:
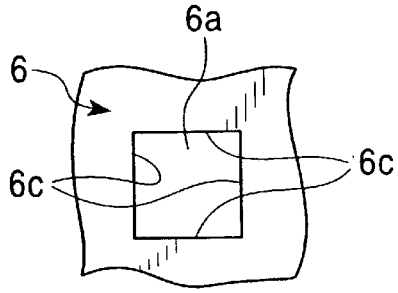
FIG. 20 is an enlarged view of the main portion of FIG. 19.

As shown in FIG. 20, each mounting hole 6*a* is enclosed by a pair of corresponding opposing first side walls 6*b* and a pair of corresponding opposing second side walls 6*c*, and is formed into a rectangular shape. A plurality of small circular positioning holes 6*d* are punched out at portions of the holding plate 6 towards the outer periphery thereof.

For the holding plate 6, one key arranging plate is used. However, the plate used may be such as to be divided into a plurality of key arranging plates, that is, a common plate 6*e* and a changing plate 6*f*, as a result of dividing one plate along division lines N (shown by the alternate long and short dash lines) shown in FIG. 19.

Figure 21:
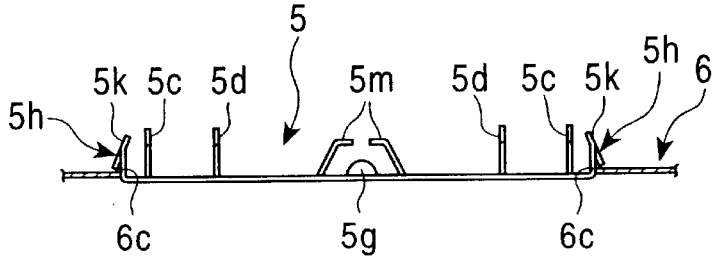
FIG. 21 illustrates an integrally formed holding plate and lever mounting plate used in the present invention.

The lever mounting plate 5 is snapped in the mounting holes 6*a* of the holding plate 6 and is temporarily held thereat in the following way. As shown in FIG. 21, the lever mounting plate 5 is positioned at the bottom portion of the holding plate 6. When the lever mounting plate 5 is pushed into the mounting holes 6*a*, the hooks 5*k* are pushed into the mounting holes 6*a* while being elastically deformed along the second side walls 6*c*. This causes the lever mounting plate 5 to be snapped in the mounting holes 6*a* and, thus, to be temporarily held.

The lever mounting plate 5, that has been temporarily held in the mounting holes 6*a* as a result of snapping them in the mounting holes 6*a*, is positioned inside the mounting holes 6*a* as a result of bringing the right end surfaces of the stopper portions 5*h* (shown in FIG. 17) and the left end surfaces of the third cut-up portions 5*m* into contact with the first side walls 6*b* of the corresponding mounting holes 6*a*.

Figure 2:
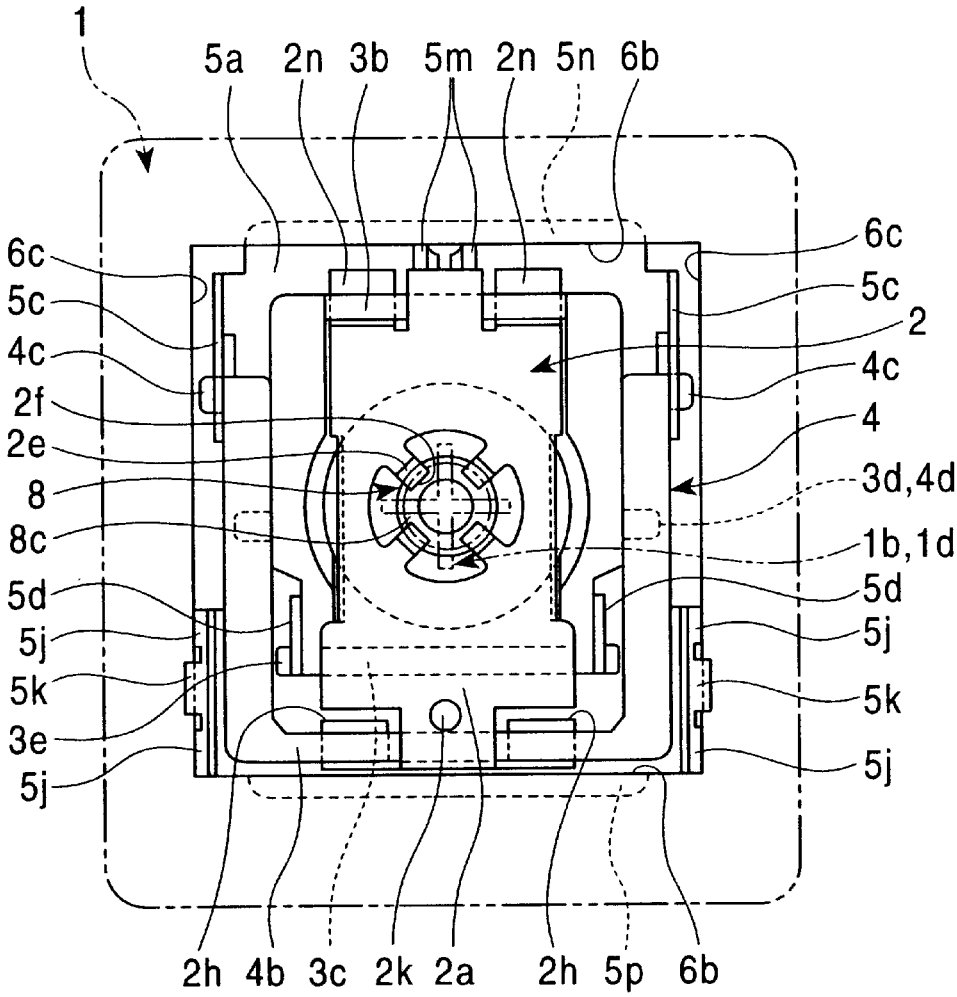
FIG. 2 is a plan view of FIG. 1.

As shown in FIG. 2, the lever mounting plate 5, that has been temporarily held by the holding plate 6 as a result of a snap-in operation of the stopper portions 5*h* with respect to the holding plate 6, is prevented from getting dislodged as a result of bringing the left end 5*n* and the right end 5*p* of the base 5*a* into contact with the back surface of the holding plate 6.

As shown in FIG. 1, the membrane switch 7 having switch elements formed thereon is disposed at the bottom portion of the holding plate 6 that temporarily holds the lever mounting plate 5.

Figure 22:
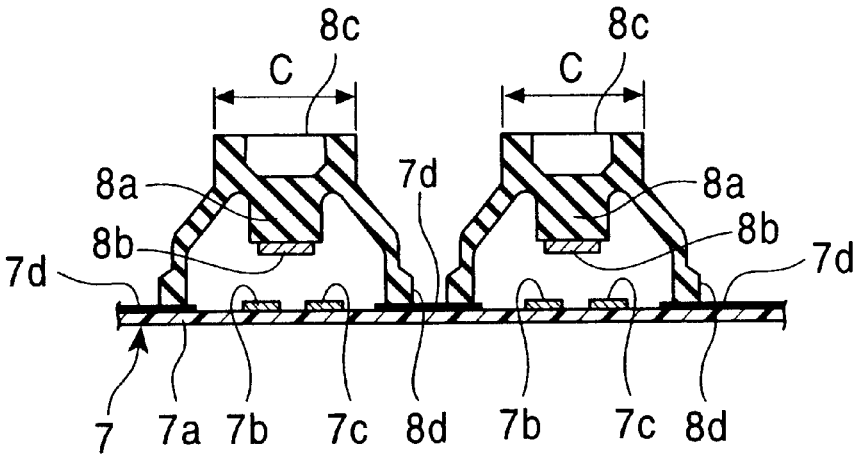
FIG. 22 is a sectional view showing elastic members mounted to a membrane switch, used in the present invention.

As shown in FIG. 22, the membrane switch 7 is formed by forming the first electrodes 7*b* and the second electrodes 7*c* opposing them, which are switch elements, on an insulating film sheet 7*a* by, for example, printing.

When the first electrodes 7*b* and the second electrodes 7*c* contact electrically conducting portions 8*b* of the elastic members 8 (described later), electrical conduction occurs therebetween, thereby turning on the membrane switch 7.

With the first electrodes 7*b* and the second electrodes 7*c* being exposed, resist films 7*d* having predetermined thicknesses are formed near the first electrodes 7*b* and the second electrodes 7*c*. The top surface of a wiring pattern (not shown) led out from the first electrodes 7*b* and the second electrodes 7*c* are covered by the resist films 7*d* in order to be insulated.

An air hole (not shown) is formed by punching out a portion of the film sheet 7*a* near the first electrodes 7*b* or the second electrodes 7*c*.

The elastic members 8, having dome-shaped inside portions, are disposed above the first electrodes 7*b* and the second electrodes 7*c*. The elastic members 8 have corresponding presser protrusions 8*a* that protrude downward from corresponding inside dome-shaped ceilings. The electrically conducting portions 8*b*, which are electrically conductive films, are formed at the bottom ends of the corresponding presser protrusions 8*a* by printing or the like.

The elastic members 8 have circular top portions 8*c* which protrude from the corresponding dome-shaped ceilings and which have diameters C. Skirts 8*d* are formed at the dome-shaped bottom portions of the corresponding elastic members 8. The skirts 8*d* are affixed to the corresponding resist films 7*d* of the membrane switch 7 with, for example, an adhesive in order to form the membrane switch 7 and the elastic members 8 into an integral structure.

A metal plate 9, which is a metal plate formed of, for example, aluminum, is formed at the bottom portion of the membrane switch 7 shown in FIG. 1. The metal plate 9 has an air hole (not shown) which is formed by punching out a portion thereof in correspondence with the location of the air hole (not shown) in the membrane switch 7, and which is of the same size as the air hole (not shown) formed in the membrane switch 7. It is formed so that, when the elastic members 8 are pushed and deformed, the air inside the elastic members 8 can escape to the outside.

The metal plate 9 has a plurality of positioning protrusions (not shown). These positioning protrusions are fitted to the positioning holes 6*d* of the holding plate 6 and a positioning hole (not shown) of the membrane switch 7 in order to position the holding plate 6 and the membrane switch 7 at the metal plate 9.

A description of the assembly the keyswitch of the present invention having such structure will be given with reference to FIGS. 23 to 25. As shown in FIG. 25, in the assembly of a lever-mounting-plate primary-half-finished product in which the bottom ends of the lever members 3 and 4 that are integrally formed by molding different types of materials are mounted to the lever mounting plate 5, the bottom-end rotating pins 3*e*, or the bottom end of the inner lever member 3, are positioned near the open portions of the rotation engaging portions 5*f* at the corresponding second cut-up portions 5*d*, and the bottom-end slide pins 4*c*, or the bottom end of the outer lever member 4, are positioned near the open portions of the slide engaging sections 5*e* at the first cut-up portions 5*c*.

When the pair of lever members 3 and 4 are moved from right to left, from one side to the other in FIG. 25, the bottom-end slide pins 4*c* of the outer lever member 4 are moved in the direction of arrow D, and engage the slide engaging sections 5*e* formed at the corresponding first cutup portions 5*c*.

The bottom-end rotating pins 3*e* of the inner lever member 3 are moved in the direction of arrow E, and are inserted into the rotation engaging sections 5*f*. This causes the bottom-end rotating shaft 3*c* to be bent by the protrusion 5*g* and to be moved towards the left in FIG. 25, so that the bottom-end rotating pins 3*e* are snapped in the rotation engaging sections 5*f* and are prevented from becoming dislodged.

The bottom-end rotating pins 3*e* are rotable inside the corresponding rotation engaging sections 5*f*, and the bottom-end slide pins 4*c* are slidable inside the corresponding slide engaging sections 5*e*.

At this time, the top-end slide shaft 3*d*, or the top end of the lever member 3, and the top-end rotating shaft 4*b*, or the top end of the lever member 4, are capable of moving up and down.

In the assembly of the lever-mounting-plate primary-half-finished-product in which the pair of lever members 3 and 4 are mounted to the lever mounting plate 5, the slide engaging sections 5*e* and the rotation engaging sections 5*f* of the lever mounting plate 5 are open in the same direction, so that the integrally formed pair of lever members 3 and 4 can be mounted to the lever mounting plate 5 for assembly by only moving them from one side to the other, thereby facilitating the automation of the assembly.

Figure 24:
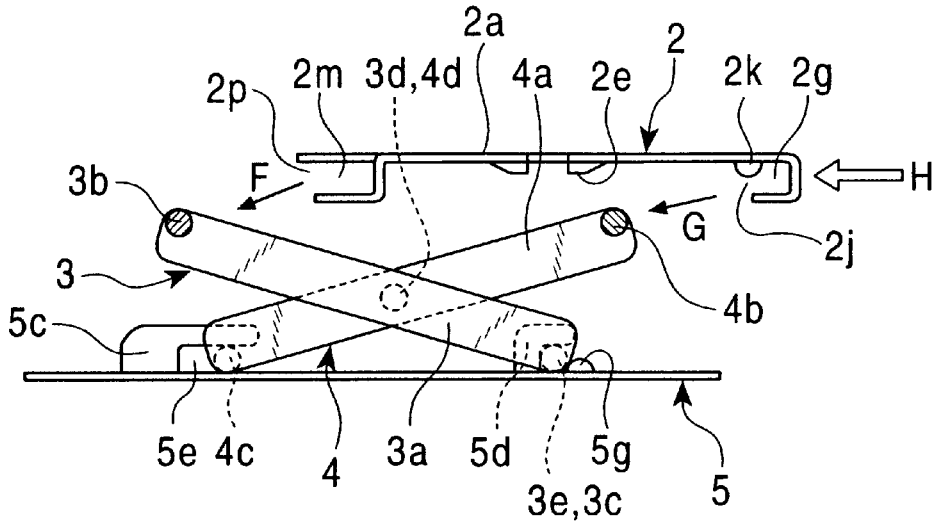
FIG. 24 illustrates a step in the method of assembling the keyswitch in accordance with the present invention.
Figure 25:
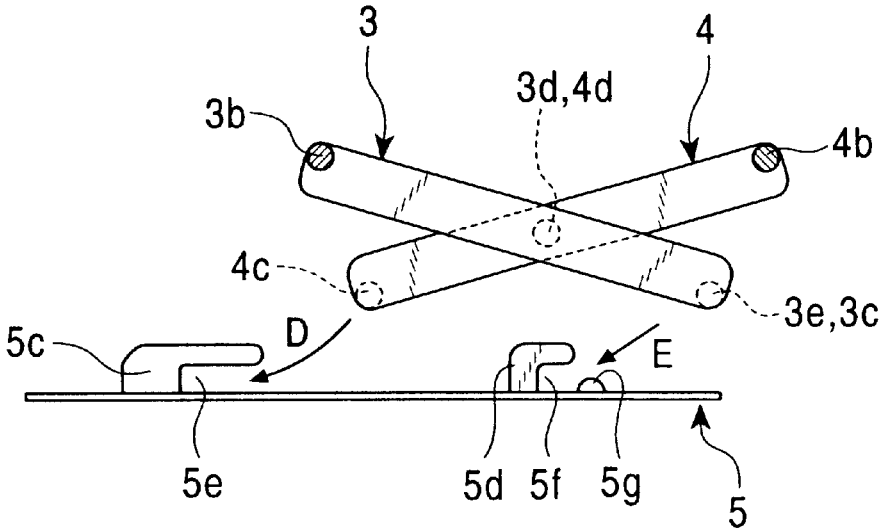
FIG. 25 illustrates a step in the method of assembling the keyswitch in accordance with the present invention.

As shown in FIG. 24, in the assembly of a lever-mounting-plate secondary-half-finished-product in which the actuator 2 is mounted to the pair of lever members 3 and 4 that have been mounted to the lever mounting plate 5, the slide shaft 3*b*, or the top end of the lever member 3 (of the lever-mounting-plate primary-half-finished product), and the top-end rotating shaft 4*b*, or the top end of the lever member 4 (of the lever-mounting-plate primary-half-finished product), are moved upward in such a manner as to cross each other in the form of the shape of the letter X.

With the pair of lever members 3 and 4 crossing each other so as to form the shape of the letter X, the open portions 2*j* at the rotation engaging section 2*g* of the actuator 2 are positioned near the top-end rotating shaft 4*b* of the outer lever member 4, and the open portions 2*p* at the slide engaging section 2*m* of the actuator 2 are positioned near the top-end slide shaft 3*b* of the inner lever member 3.

When weight is exerted in the direction of arrow H parallel to the mounting surface 2*a* from the rotation engaging section 2*g* of the actuator 2, the actuator 2 moves from right to left (from one side to the other in FIG. 24), causing the slide engaging section 2*m* to move in the direction of arrow F and the top-end slide shaft 3*b* of the inner lever member 3 to be slidably inserted into the slide engaging section 2*m*.

The rotation engaging section 2*g* move in the direction of arrow G, causing the top-end rotating shaft 4*b* of the outer lever member 4 to be rotatably snapped in the rotation engaging section 2*g*.

In the lever-mounting-plate secondary-half-finished product, the open portions of the rotation engaging section 2*g* and those of the slide engaging section 2*m* are open in the same direction, so that the actuator 2 can be mounted to the pair of lever members 3 and 4 by only moving the actuator 2 from one side to the other, thereby facilitating the automation of the assembly.

Figure 23:
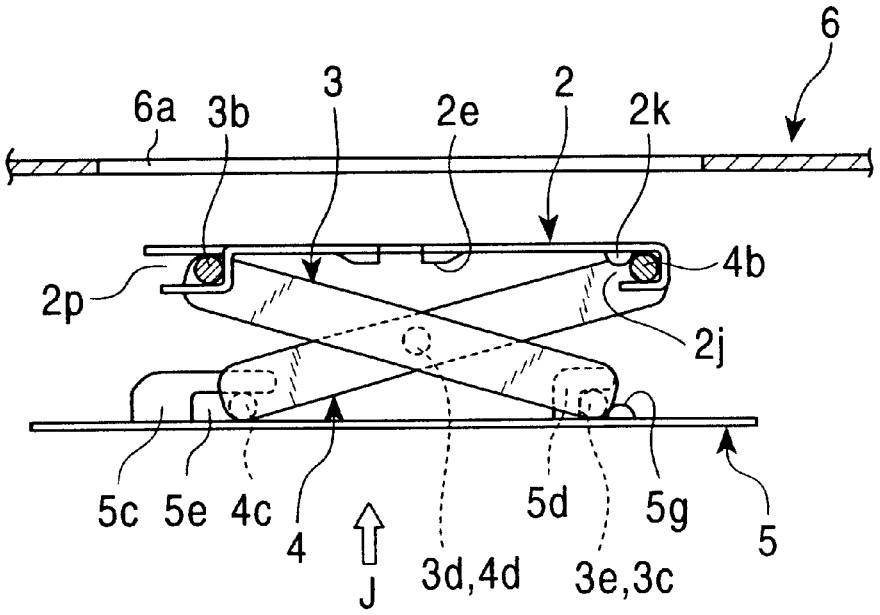
FIG. 23 illustrates a step in the method of assembling the keyswitch in accordance with the present invention.

Next, as shown in FIG. 23, in the assembly of a holding-plate primary-half-finished product in which the lever-mounting-plate secondary-half-finished product having the actuator 2 mounted therein is snapped in and temporarily held in the mounting holes 6*a* of the holding plate 6, the lever-mounting-plate secondary-half-finished product is positioned below the mounting holes 6*a* of the holding plate 6. Then, the lever mounting plate 5 is raised upward in the direction of arrow J, and is pushed into the mounting holes 6*a*.

When this is done, the stopper portions 5*h* of the lever mounting plate 5 are pushed into the inside of and snapped in the mounting holes 6*a*, and the left end 5*n* and the right end 5*p* come into contact with and are stopped by the back surface of the holding plate 6 so as not to get dislodged. This causes the lever-mounting-plate secondary-half-finished product to be temporarily held by the holding plate 6, thereby assembling the holding-plate primary-half-finished product.

In the assembly of the holding-plate primary-half-finished product, a plurality of the lever-mounting-plate secondary-half-finished product can be arranged in a row at the same locations as the plurality of mounting holes 6*a* of the holding plate 6 in order for the lever mounting plate 5 to be snapped in the plurality of mounting holes 6*a* all at once for assembly, thereby facilitating the automation of the assembly.

In the holding-plate primary-half-finished product assembled by carrying out this procedure, even when a twisting force in the direction of rotation is applied to the lever mounting plate 5 that is temporarily held by the holding plate 6, the illustrated bottom ends of the stopper portions 5*h* of the lever mounting plate 5 contact the illustrated bottom first side walls 6*b* of the mounting holes 6*a*, and the third cut-up portions 5*m* contact the illustrated top first side walls 6*b* of the mounting holes 6*a*, so that twisting of the lever mounting plate 5 is restricted.

By providing a plurality of third cut-up portions 5*m* shown in FIG. 2 along the illustrated top first side walls 6*b*, the twisting of the lever mounting plate 5 can be more reliably restricted.

In the assembly of a holding-plate secondary-half-finished product in which the keytop 1 is mounted to the actuator 2 of the holding-plate primary-half-finished product, the protrusion 1*b* of the keytop 1 is positioned at the dislodging-preventing stopper portion 2*b* of the actuator 2 of the holding-plate primary-half-finished product, and the cross-shaped presser portion 1*d* is positioned between the press-contact portions 2*e*.

When the bottom surface side of the mounting surface 2*a* of the actuator 2 is placed on a jig (not shown), and the keytop 1 is pressed from above by, for example, the jig, the protrusion 1*b* is press-fitted to the dislodging-preventing stopper portion 2*b*.

At this time, as shown in FIG. 1, the ends 2*f* of the four press-contact sides 2*e* press-contact the four side surfaces 1*c* at the protrusion 1*b* in order for the keytop 1 to be mounted to the actuator 2 by holding it so that it does not get dislodged, whereby the holding-plate secondary-half-finished product is assembled.

In the assembly of the holding-plate secondary-half-finished product, a plurality of the keytops 1 can be positioned at corresponding dislodging-preventing stopper portions 2*b* of a plurality of actuators 2, and can be press-fitted at the same time by one press-fitting operation, so that the automation of the assembly is facilitated.

Next, the membrane switch 7, formed integrally with the elastic members 8, is placed on the metal plate 9 shown in FIG. 1, and the holding-plate half-finished product having the keytop 1 mounted therein is placed on the membrane switch 7.

This causes a plurality of elastic members 8 to be inserted into and positioned at a plurality of through holes 5*b* at the center portion of the lever mounting plate 5, causing the top portions 8*c* of the elastic members 8 to come into contact with the cross-shaped presser portion 1*d* of the keytop 1. The keytop 1 is elastically biased upward in FIG. 1, and the pair of lever members 3 and 4 move upward, so that they form the shape of the letter X shown in FIG. 1.

In the keyswitch of the present invention assembled by this procedure, when the keytop 1 shown in FIG. 1 is moved downward as a result of pushing it downward, the tilting legs 3*a* and 4*a* of the corresponding lever members 3 and 4 that cross each other so as to form the shape of the letter X are tilted, and are brought into substantially horizontal positions.

Then, the dome-shaped elastic members 8 are deformed and buckled as a result of being directly pushed by the presser portion 1*d* of the keytop 1. The buckling causes a tactile feel to be produced at the elastic members 8, and the first electrodes 7*b* and the second electrodes 7*c* to be brought into electrical conduction as a result of the electrically conductive portions 8*b* of the corresponding elastic members 8 coming into contact with the first electrodes 7*b* and the second electrodes 7*c* of the membrane switch 7.

The switch elements, that is, the first electrodes 7*b* and the second electrodes 7*c*, are turned on in order to perform a switching operation.

Here, since the elastic members 8 are directly in contact with the keytop 1 in order to be elastically biased, the tactile feel produced at the elastic members 8 is directly transmitted to the keytop 1, so that the user can operate the keytop 1 with a proper feel.

With the switch elements being switched on, when the pushing force on the keytop 1 is removed, the buckled elastic members 8 are restored to their original dome-shaped forms by their own elastic forces, causing the presser portion 1*b* of the keytop 1 to move upward as a result of being directly pushed upward by the elastic members 8.

Then, the tilting legs 3*a* and 4*a* of the corresponding levers 3 and 4 return to their initial state or the X-shaped crossed state, as shown in FIG. 1. When the elastic members 8 are restored to their original dome-shaped forms, the electrically conductive portions 8*b* which have been brought into electrical conduction with their corresponding first and second electrodes 7*b* and 7*c* as a result of being brought into contact with them move upward, thereby turning off the switch elements.

In the description of the embodiment of the present invention, the protrusion 1*b* of the keytop 1 is described as a square-pole-shaped protrusion having four side surfaces 1*c*. However, the protrusion 1*b* does not have to have the shape of a square pole. For example, it may be formed so as to have the shape of a polyhedral pole. A plurality of flat side surfaces are formed along the protrusion, and the actuator 2 is formed with the number of press-contact portions in correspondence with the plurality of side surfaces. These press-contact portions are such as to be press-contacted to the plurality of side surfaces, respectively.

As can be understood from the foregoing description, according to the keyswitch of the present invention, the keytop is held by the actuator, and the elastic members directly elastically bias the keytop. With the upward and downward movement of the keytop, the pair of lever members can move up and down through the actuator. Therefore, the mounting of the pair of lever members to the actuator is simplified, thereby facilitating the automation of the assembly. Therefore, it is possible to provide a low-cost keyswitch.

The top ends of the pair of lever members are mounted to the actuator, so that it is not necessary for the keytop to have mounting portions for mounting the lever members thereto. This simplifies the structure of the keytop. In addition, it makes it unnecessary to use a sophisticated die for forming the keytop by molding, thereby making it possible to considerably reduce the die cost, and, thus, to reduce to cost of the keytop.

The actuator has a dislodging-preventing stopper portion which can prevent the dislodging of the actuator as a result of press-contacting it to the side surfaces provided therearound, with a plurality of press-contact portions supported in a cantilever manner being formed at the dislodging-preventing stopper portion. The keytop is held by the actuator as a result of press-contacting the press-contact portions to the side surfaces at the protrusion. Therefore, by press-fitting the keytop to the dislodging-preventing stopper portion of the actuator, the keytop can be firmly held by the actuator.

Therefore, the force required to pull out the keytop can be made large, so that, even when an operating weight which pushes the keytop obliquely is applied, the keytop is not tilted.

The press-contact portions are formed so as to protrude inwardly from the inner peripheral wall defining the through hole in the actuator in order to be supported in a cantilever manner. In addition, the ends of the press-contact portions are such as to be press-contacted to the corresponding side surfaces at the protrusion. Therefore, it is possible to hold the keytop to the actuator even more firmly, thereby making it possible to increase the force required to pull off the keytop.

The actuator is formed of a metallic plate, the press-contact portions are formed so as to protrude inwardly from the four directions of the inner peripheral wall of the through hole, the keytop is formed of a resin material, the prismatic protrusion is formed with the shape of a square pole, and the press-contact portions are such as to be press-contacted to the four sides along the prismatic protrusion. Therefore, the keytop and the actuator can be easily manufactured, thereby making it possible to reduce costs.

At the square-pole-shaped protrusion is formed a cross-shaped presser portion which protrudes in the diagonal direction from a corner where the side surfaces at the protrusion intersect. The length of the presser portion in the diagonal direction is larger than the sizes of the top portions of the elastic members. In addition, the presser portion is brought into contact with the top portions of the elastic members, so that the elastic members directly elastically bias the keytop. Therefore, the tactile feel produced at the elastic members is directly transmitted to the keytop. Consequently, it is possible to provide a high-quality keyswitch that provides a proper operational feel.

The actuator has a rotation engaging section which has an open portion and which allows the top end of one of the pair of lever members to rotatably engage therewith, and a slide engaging section which has an open portion and which allows the top end of the other lever member to slidably engage therewith, with the open portions of the rotation engaging section and the slide engaging section being formed so as to open in the same direction. Therefore, the top ends of the lever members can engage their corresponding rotation engaging section and the slide engaging section by simply moving the actuator towards one side in the horizontal direction. Therefore, it is possible to provide a key switch whose assembly can be easily automated.

The rotation engaging section is formed at one end of the actuator so as to have a U-shaped side surface. A protrusion is formed near the open portion of the U-shaped rotation engaging section, at either one of or both of the opposing sides thereof. The protrusion or protrusions reduce the width of the open portions. Therefore, the top end of one of the pair of lever members can engage the rotation engaging section from the small-width open portions by a snap-in operation as a result of carrying out a one-touch operation.

Therefore, it is possible to provide a keyswitch that can be easily assembled.

The slide engaging section is formed at the other end of the actuator so as to have a U-shaped side surface. The two opposing sides of the U-shaped slide engaging section are formed parallel to each other. Therefore, it is possible for the top end of one of the lever members to engage the rotation engaging section by a snap-in operation, and the top end of the other lever member to slidably engage the slide engaging section, thereby facilitating assembly.

The actuator is formed of a metallic plate, and the rotation engaging section and the slide engaging section are bent so that they have U-shaped side surfaces. Therefore, the actuator can be produced by, for example, a pressing operation, and a keyswitch having a high-precision actuator can be provided at a low cost.

The strengths of the pair of lever members to which an actuator, formed of a metallic plate, is mounted can be increased.

In the method of assembling a keyswitch in accordance with the present invention, a pushing weight is exerted from one side of the actuator in a direction parallel to the mounting surface thereof in order to mount the actuator to the top ends of the pair of lever members as a result of engaging it therewith. Therefore, the assembly is simplified, and the automation of the assembly is facilitated.

By exerting a pushing weight to the mounting surface of the actuator, the rotation engaging section, formed at one end of the mounting surface, engages the top end of one of the lever members by a snap-in operation, and the slide engaging section, formed at the other end of the mounting surface, is mounted to the top end of the other lever member as a result of slidably engaging it therewith. Therefore, the assembly is further simplified.

What is claimed is:

1. A keyswitch comprising:

a pair of lever members which are rotatably linked at a portion where the lever members cross each other;

a keytop supported by the pair of lever members so as to be movable upward and downward;

an elastic member for elastically biasing the keytop upward; and a switch element which is subjectable to a switching operation with the upward and downward movement of the keytop;

wherein an actuator is engaged by a top end of each of the pair of lever members;

wherein the keytop is held by the actuator;

wherein the elastic member directly elastically biases the keytop;

wherein, with the upward and downward movement of the keytop, the pair of lever members are movable upward and downward through the actuator;

wherein a prismatic protrusion is formed at a portion of the keytop that is stopped by the actuator, and side surfaces formed at a periphery of the prismatic protrusion are formed flat; and wherein the actuator has a dislodging preventing stopper portion capable of preventing the actuator from becoming dislodged by being press-contacted to the side surfaces at the periphery of the protrusion, a plurality of press-contact portions supported in a cantilever manner being provided at the dislodging-preventing stopper portion, and the press-contact portions being press-contacted to the corresponding side surfaces at the protrusion in order to stop the keytop by the actuator.

2. A keyswitch according to claim 1, wherein the press-contact portions are formed so as to be supported in the cantilever manner by causing the press-contact portions to protrude inwardly from an inner peripheral wall defining a hole which passes through the actuator, and ends of the press-contact portions are such as to press-contact the corresponding side surfaces at the protrusion.

3. A keyswitch according to claim 2, wherein the actuator is formed of a metallic plate, and the press-contact portions are formed so as to protrude inwardly from four directions of the inner peripheral wall defining the hole, wherein the keytop is formed of a resin material, and the prismatic protrusion has the shape of a square pole, and wherein the press-contact portions are press-fitted to corresponding four side surfaces at the periphery of the square-pole-shaped protrusion.

4. A keyswitch according to claim 3, wherein the square-pole-shaped protrusion has a cross-shaped presser portion formed so as to protrude in a diagonal direction from a corner where the side surfaces intersect each other, the length of the presser portion in the diagonal direction being greater than the size of a top portion of the elastic member, and the presser portion being brought into contact with the top portion of the elastic member in order for the elastic member to elastically bias the keytop.

5. A keyswitch comprising:

a pair of lever members which are rotatably linked at a portion where the lever members cross each other;

a keytop supported by the pair of lever members so as to be movable upward and downward;

an elastic member for elastically biasing the keytop upward; and a switch element which is subjectable to a switching operation with the upward and downward movement of the keytop;

wherein a lever mounting plate with which bottom ends of the pair of lever members are engageable is provided, the lever mounting plate being mounted to a holding plate and being placed on the switch element, wherein an actuator is engaged by a top end of each of pair of lever members, wherein the keytop is held by the actuator, wherein the lever mounting plate includes a bottom rotation engaging section and a bottom slide engaging section, the bottom rotation engaging section having an open portion and allowing the bottom end of one of the lever members to rotatably engage therewith, the bottom slide engaging section having an open portion and allowing the bottom end of the other lever member to slid ably engage therewith, wherein the actuator includes a top rotation engaging section and a top slide engaging section, the top rotation engaging section having an open portion and allowing the top end of one of the lever members to rotatably engage therewith, the top slide engaging section having an open portion and allowing the top end of the other lever member to slidably engage therewith, wherein the open portion of the bottom rotation engaging section and the open portion of the bottom slide engaging section open in a same direction, wherein the open portion of the top rotation engaging section and the open portion of the top slide engaging section open in the same direction, and wherein the open portions of both bottom engaging sections and the open portions of both top engaging sections open in opposite directions.

6. A keyswitch according to claim 5, wherein the lever mounting plate is a metallic plate, the lever mounting plate having a pair of first cut-up portions at one side thereof, the slide engaging section which has the open portion being formed into a U shape at the first cut-up portions, and two opposing sides of the U-shaped slide engaging section being formed parallel to each other.

7. A keyswitch according to claim 6, wherein a pair of second cut-up portions are formed at another side of the lever mounting plate so as to be separated from the first cut-up portions, the rotation engaging section being formed into a U shape at the second cut-up portions, and a protrusion being formed near the open portion at either one of or both opposing sides of the rotation engaging section, the protrusion being provided to reduce the width of the open portion.

8. A method of assembling a keyswitch, wherein:

a pair of lever members which are rotatably linked at a portion where the lever members cross each other are provided;

wherein top ends of the pair of lever members are made movable upward and downward through an actuator with an upward and downward movement of a keytop which is elastically biased by an elastic member;

wherein the actuator includes a top rotation engaging section and a top slide engaging section, the top rotation engaging section having an open portion and allowing the top end of one of the lever members to rotatably engage therewith, the top slide engaging section having an open portion and allowing the top end of the other lever member to slidably engage therewith;

wherein bottom ends of the pair of lever members are made engageable with a lever mounting plate;

wherein the bottom ends of the pair of lever members are positioned on the lever mounting member, the pair of lever members are moved from one side to the other, and the bottom ends of the pair of lever members are made to engage the lever mounting plate in order to assemble the keyswitch;

wherein the lever mounting plate includes a bottom rotation engaging section and a bottom slide engaging section, the bottom rotation engaging section having an open portion and allowing the bottom end of one of the lever members to rotatably engage therewith, the bottom slide engaging section having an open portion and allowing the bottom end of the other lever member to slidably engage therewith;

wherein the open portion of the bottom rotation engaging section and the open portion of the bottom slide engaging section open in a same direction, the open portion of the top rotation engaging section and the open portion of the top slide engaging section open in the same direction, and the open portions of both bottom engaging sections and the open portions of both top engaging sections open in opposite directions.

9. A method of assembling a keyswitch according to claim 8, wherein by moving the pair of lever members from one side to the other, the bottom end of one of the lever members engages a rotation engaging section of the lever mounting plate by a snap-in operation so that the one of the lever members is rotatable thereat, and the bottom end of the other lever member is slid and is made to engage a slide engaging section of the lever mounting plate so that the other lever member is slidable thereat.

* * * * *

UNITED STATES PATENT AND TRADEMARK OFFICE

CERTIFICATE OF CORRECTION

PATENT NO. : 6,689,977 B2
DATED : February 10, 2004
INVENTOR(S) : Takayuki Ito et al.

It is certified that error appears in the above-identified patent and that said Letters Patent is hereby corrected as shown below:

Title page,
Item [56], References Cited, U.S. PATENT DOCUMENTS, insert
-- 6,107,584 08/2000 Yoneyama --.

Column 16,
Line 24, before "engage" delete "slid ably" and substitute -- slidably -- in its place.

Signed and Sealed this

Thirteenth Day of July, 2004

JON W. DUDAS
*Acting Director of the United States Patent and Trademark Office*